US005848722A

United States Patent [19]

Hanes

[11] Patent Number: 5,848,722

[45] Date of Patent: Dec. 15, 1998

[54] SPILL RESISTANT HOLDER FOR MUG

[76] Inventor: Eldridge C. Hanes, 111 Cloverleaf Dr., Winston-Salem, N.C. 27103

[21] Appl. No.: 862,850

[22] Filed: May 23, 1997

[51] Int. Cl.[6] ..... B65D 25/00

[52] U.S. Cl. ..... 220/741; 215/387; 222/703; 222/714; 222/740; 224/926

[58] Field of Search ..... 220/741, 401, 220/737, 227, 731, 229, 718, 716, 714, 703, 740; 215/387; 222/183, 109; 224/926

[56] References Cited

U.S. PATENT DOCUMENTS

| | | | |
|---|---|---|---|
| D. 225,435 | 12/1972 | Anthony | 220/737 X |
| 2,226,146 | 12/1940 | Smith | 220/718 |
| 2,535,273 | 12/1950 | Deutschman | 222/183 |
| 3,203,598 | 8/1965 | Alford | 222/183 |
| 3,719,305 | 3/1973 | Pressnell | 220/740 |
| 3,797,696 | 3/1974 | Dibrell | 220/714 |
| 3,915,331 | 10/1975 | Chenaulet | 220/714 X |
| 3,979,011 | 9/1976 | Schleicher | 220/741 X |
| 4,127,211 | 11/1978 | Zerbey | 224/926 X |
| 4,148,418 | 4/1979 | Ewing et al. | 220/740 X |
| 5,088,673 | 2/1992 | Chandler | 224/926 X |
| 5,326,064 | 7/1994 | Sapien | 224/926 X |
| 5,609,277 | 3/1997 | McDonald | 224/148.7 X |

*Primary Examiner*—Stephen K. Cronin
*Assistant Examiner*—Robin A. Hylton

[57] ABSTRACT

A mug beverage spill resistant container holder with spaced apart first and second circular members held in place by a connecting member having a substantially vertical opening therein. The second circular member has a top portion with at least one discrete opening to permit the flow of beverage when being used by a consumer but operable to prevent beverage spill during ordinary handling. The second circular member has a cylindrical skirt portion adapted for encirclement and attachment to the top of a beverage container, and the first circular member has a lower circular portion having a configuration that enables it to be positioned in a standard size beverage holder such as those provided in new model automobiles.

20 Claims, 1 Drawing Sheet

SPILL RESISTANT HOLDER FOR MUG

BACKGROUND OF THE INVENTION

1. Field of the Invention

The present invention relates to beverage container holders and safety lids for use with conventional mugs or beverage containers and more particularly, to a holder that cooperatively receives the container to snugly retain and support it and prevent beverage spill during conventional use and a safety lid which alone or in combination with the holder with such containers.

2. Description of the Prior Art

The present invention is applicable to mugs and beverage containers alike which shall hereinafter be collectively referred to as "mugs." It shall also be described hereinafter in connection primarily with a conventional mug, although it will be appreciated that the principles of the present invention are also applicable to all conventional beverage containers.

There are a number of mug holders that are available for use for example, in automobiles where ashtrays have now primarily been replaced with drink holders. For the most part, these drink holders are of a size to accommodate a soft drink can and are not of a size sufficient to supportingly receive a conventional mug. To adapt such holders for mug use, a number of inserts have been developed that has a smaller bottom portion which extends through the automobile drink holder and has a larger upper portion with a diameter sufficiently size to receive a conventional mug therein. Thus, the adapter can hold the mug, even though the unit furnished with the automobile was of insufficient size to do so.

While these adapters are appropriate for cooperatively receiving conventionally sized mugs, they, for the most part, do not have suitable means for preventing beverage spill as the car moves and turns or engages un-even surfaces. To control beverage spill, it is necessary to use a safety lid which is fashioned to prevent general beverage spill but to allow the consumer to sip the beverage contained therein, at least to a moderate degree. There are many safety lids available for use with mugs and they perform two primary functions. First, they cover the open mouth of the mug to prevent the liquid contained in the mug from spilling and secondly, they help to maintain the temperature of hot liquid in the mug by preventing the escape of steam.

Many of the currently available safety lids suffer from a number of drawbacks, the most serious being that these lids are not securely retained at the mouth of the mug which allows spillage of the liquid if the mug is tipped over. These lids also make it inconvenient for a user to drink from the mug, since an insecure lid usually means that the user must hold the lid while drinking.

Several attempts have been made to remedy this undesirable feature, such as the provisional of snap fit lids, but these are somewhat unreliable since they must be entirely snapped in place to be effective.

Other examples of safety lids are shown in U.S. Pat. Nos. 5,018,636 and 5,102,000. While each of these references discloses mug and lid combinations having a somewhat secure fit of the lid to the mouth of the mug, in each case a specific mug and lid combination must be provided. Each of the mugs used in these references must be used with its intended lid. None of these lids can be adapted for use with a variety of conventional mugs.

It is desirable to have a more positively receiving mug holder and a more practical and flexible safety lid alone and in combination therewith that is designed to accommodate mugs and various containers alike. A combination unit that it inexpensive, simple to use and durable in construction has particular value in view of the difficulties associated with prior art holders and safety lids. It is to this need for a combined receptacle holder and safety lid and for a more efficient safety lid used singularly which can be adapted for use with any conventional mug, that the present invention is directed.

SUMMARY OF THE INVENTION

The objects of the present invention may be achieved by providing a mug beverage spill resistant container holder having a first circular member with a flared circular wall and a second generally circular member having a substantially closed top portion forming a safety lid. The first and second circular members are maintained in a spaced apart relationship from each other by a connecting member which has a substantially vertical opening therein which will accommodate the handle of a conventional mug. The second circular member top portion has at least one discrete opening therein to permit the flow of beverage when being used by a consumer but operable to prevent beverage spill during ordinary handling. The second circular member has a cylindrical skirt portion adapted for encirclement and attachment to the top of a beverage container thereby receiving the top within the skirt portion which is held in position by some frictional fit along with the gripping action exerted by the connecting member. The second circular member can be used alone as a safety lid as well as in the combination.

The first circular member has a lower circular portion having a smaller diameter than the first circular member diameter and is adapted to fit into a beverage holder of standard size to enable that standard size holder forming a part of, for example, an automobile to support the mug beverage container holder and a beverage container carried therein.

In another embodiment of the present invention, a first circular member lower portion is adapted to cooperatively receive a heat or cooling responsive material so that the beverage can be maintained in the holder in a heated or cooled condition for an extended period of time.

In another embodiment, the connecting member can be articulated so that the distance between the circular members can be selectively chosen and snapped in place to accommodate containers of varying heights.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concepts upon which this disclosure is based and that it may readily be utilized as a basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DESCRIPTION OF THE PREFERRED EMBODIMENTS

Figure 1:
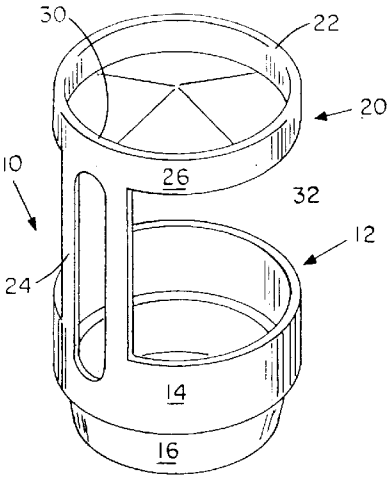
FIG. 1 is a perspective view of the mug beverage container holder comprising the present invention.
Figure 2:
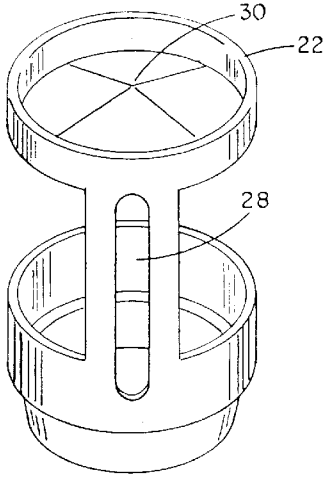
FIG. 2 is a perspective view of the container comprising the present invention turned approximately 90° from the view shown in FIG. 1.

Referring now to the drawings and particularly to FIG. 1, a mug beverage container spill resistant holder comprising the present invention is shown generally as 10 and is formed from a first generally circular member 12 having a flared circular wall 14. First circular member 12 has a lower circular portion 16 connecting with flared circular wall 14, and both form a hollow interior best shown in FIGS. 3 and 8. Lower circular portion 16 has a smaller diameter than the diameter of first circular portion 14, it being adapted to fit into a conventional beverage holder shown in hidden lines as 18 in FIG. 3 which, in turn, supports the mug beverage container holder and a beverage container carried thereby.

A second generally circular member 20 is spaced apart from and substantially parallel to first circular member 12 and has a closed top portion 22. The spill protecting features of member 22 will be discussed in greater detail subsequently.

Figure 3:
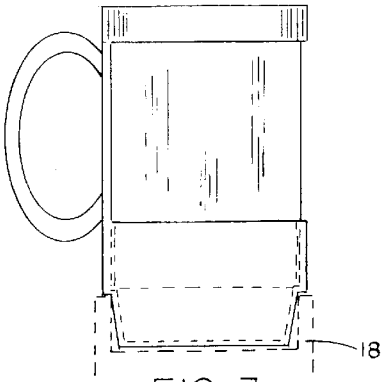
FIG. 3 is a side elevational, sectional view of the holder comprising the present invention cooperatively receiving a conventional mug.
Figure 4:
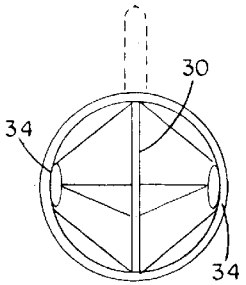
FIG. 4 is a plan view of the holder lid comprising the present invention showing the raised portion and two recessed portions of the second circular member closed top portion.

First and second circular members 12 and 20 are fixedly held in a spaced apart relationship by connecting member 24 which connects with cylindrical skirt portion 26 of second circular member 20 and with flared circular wall 14 as shown. Member 24 has a substantially vertical opening 28 therein which cooperatively receives the handle of a mug when the holder is being used with a conventional mug as shown in FIGS. 3 and 8.

Figure 9:
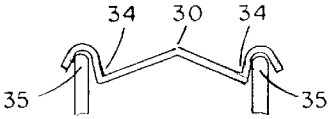
FIG. 9 is an enlarged, sectional, side elevational and fragmentary view of the second circular member engaging the rim of a mug.

Top portion 22 of second circular member 20 has a raised portion 30 which is substantially level with the upper edge 32 of cylindrical skirt portion 26 and extends diametrically across and level with that edge. From raised portion 30, closed top portion 22 slopes downwardly on either side to form recessed portions 34, each of which have a discrete opening to permit selective beverage flow when the container and holder are inclined in the direction of the appropriate recess. The second circular member top portion 20 conforms substantially to the diameter of the second circular member closed top portion raised portion. A sectional view of the second circular member engaging the rim 35 of a mug as shown in FIG. 9. The cylindrical skirt portion 26 forms at its mug rim engaging location an inverted V so that mug rim 35 snugly fits within the V about the circumference of skirt portion 26. This configuration enables mugs having walls of various thicknesses to be used with equal efficiency in the holder or the safety lid functioning alone.

Figure 8:
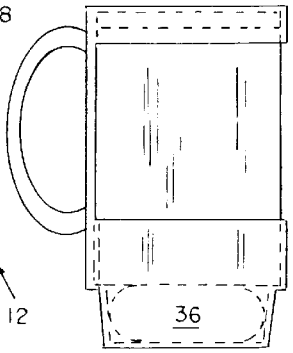
FIG. 8 is a side elevational and sectional view of another embodiment of the present invention showing the use of a heat or cooling responsive substance positioned in the lower circular portion of the first circular member to maintain the beverage contained in the container in a prolonged heated or cooled state.
Figure 5:
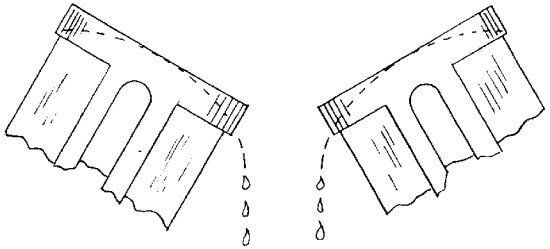
FIG. 5 is a side elevational, sectional, and partial view of the holder and a beverage containing mug being tilted in opposite directions to utilize fluid flow through the two discrete openings provided therein.

An added feature can be given the present invention by providing an appropriate substance such as a heat or cold absorbing gel shown in packaged form as 36 in FIG. 8, which can be positioned within lower circular portion 16 as shown. The size and shape of the package of gel 36 can be such that it will substantially engage the bottom of a mug inserted within holder 10. The gel can be microwaved to give it intensive heat or it can be frozen so that it will provide a cooling effect, depending on the beverage being accommodated. The application of this feature obviously gives extended pleasure to the user of the device with respect to the beverage being carried thereby.

Figure 7:
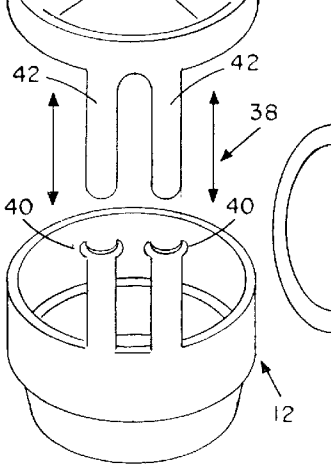
FIG. 7 is a perspective and exploded view of another embodiment of the present invention wherein the connecting member is articulated so that the first and second circular members can be selectively spaced apart a given distance and cooperatively secured in that relationship so as to enable use with varying heights of containers.
Figure 6:
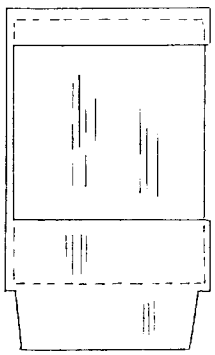
FIG. 6 is a side elevational, sectional view of the holder comprising the present invention supportingly maintaining a conventional container without a handle.

An additional optional feature is shown in FIG. 7 wherein connecting member 38 is articulated so that the first and second circular members 12 and 20 are separate components but are releasably securable with respect to each other through engaging elements 40 associated with first circular member 12 and cooperating elements 42 associated with second circular member 20. Members 40 and 42 can cooperatively engage each other and by frictional engagement and enable selective positioning of circular members 12 and 20 in any desired spaced apart relationship with each other. Obviously, any number of connecting elements may be used including telescoping elements, velcro sections, or other appropriate selectively lockable devices.

Holder 10 can be made of any convenient substance that will enable some flexing action to take place with respect to connecting member 24. The materials should be strong enough to securely hold the beverage container positioned within the holder but having some flexibility so that second circular member 20 can be flexed upwardly and rearwardly to allow the mug to be positioned between members 12 and 20 and thereafter exert some force in pulling member 20 downwardly over the top of the mug. Plastic, polyethylene, polypropylene or other equally durable somewhat flexible materials may be used to form the holder.

Obviously, the holder comprising the present invention can be made in any variety of heights and diameters to accommodate any variety of beverage container sizes. The most standard mug is of an 11 oz. capacity and has an average height of from 3½ to 4 inches and a diameter of from 3 to 3½ inches at the rim. Thicknesses of the more conventional mugs vary from ⅛ to ¼ inch.

The present invention is equally applicable to unusual containers such as steins, which have conventional sizes of from 16 oz. to 28 oz. capacity and measure in height from 5 to 7 inches.

Thus, there has been described and illustrated a mug beverage container spill resistant holder having novelty and utility. Numerous modifications and alternative embodiments of the invention will be apparent to those skilled in the art in view of the foregoing description. Accordingly, this description should be construed as illustrative only and is for the purpose of teaching those skilled in the art the best mode of carrying out the invention. The details of the structure of the invention may be varied substantially without departing from the spirit thereof, and the exclusive use of all modifications that come within the scope of the appended claims is reserved.

What is claimed is:

1. A spill resistant holder for a mug comprising: a first circular member having a flared circular wall; a second circular member having a closed top portion; and connecting means joining the first circular member with a second circular member and having a vertical opening therein, the second circular member top portion having one or more discrete openings therein to permit the flow of beverage when being a consumer but operable to prevent beverage spill ordinary handling.

2. The holder as claimed in claim 1 wherein the second circular member has a cylindrical skirt portion for encircling and attaching to the top of a beverage container.

3. The holder as claimed in claim 1 the first circular member has a lower circular portion having a smaller diameter than the first circular member diameter and for fitting into a conventional beverage holder of standard size to support the mug beverage container in a beverage container carried thereby.

4. The holder as claimed in claim 3 wherein the first circular member lower portion cooperatively receives a heat and cooling responsive material.

5. The holder as claimed in claim 1 wherein the holder supports a mug having a handle and the handle extends through the connecting means vertical opening.

6. The holder as claimed in claim 2 wherein the second circular member closed top portion has a raised portion and at least one recess portion designed to receive a discrete opening to permit beverage flow.

7. The holder as claimed in claim 3 wherein the second circular member has a cylindrical skirt portion for encircling and attaching to the top of a beverage container.

8. The holder as claimed in claim 4 wherein the second circular member has a cylindrical skirt portion for encircling and attaching to the top of a beverage container.

9. The holder as claimed in claim 5 wherein the second circular member has a cylindrical skirt portion for encircling and attaching to the top of a beverage container.

10. The holder as claimed in claim 6 wherein the first circular member has a lower circular portion having a smaller diameter than the first circular member diameter and for fitting into a conventional beverage holder of standard size to support the mug beverage container and a beverage container carried thereby.

11. The holder as claimed in claim 6 wherein the first circular member lower portion cooperatively receives a heat and cooling responsive material.

12. The holder as claimed in claim 6 wherein the holder supports the mug having a handle and the handle extends through the connecting means vertical opening.

13. A spill resistant holder for a mug comprising: a first circular member having a flared circular wall for receiving the base of a mug beverage container and resists dislodgement thereof; a second circular member having a closed top portion with two discrete openings therein; and connecting means joining the first circular member with the second circular member and having a vertical opening therein, wherein the second circular member as a cylindrical skirt portion for encircling and attaching to the top of a beverage container, the first circular member having a lower circular portion with a smaller diameter than the first circular member diameter for fitting into a conventional beverage holder of standard size to support the mug beverage container and a beverage container carried thereby, the first circular member lower portion cooperatively receiving a heat and cooling responsive material, and the holder supporting a mug having a handle and a handle extending through the connecting means vertical opening.

14. The holder as claimed in claim 13 wherein the second circular member closed top portion has a raised portion and two recessed portions, each of the recessed portions designed to receive a discrete opening to permit selective beverage flow.

15. The holder as claimed in claim 14 wherein the second circular member top portion raised portion conforms to the diameter of the second circular member top portion.

16. The holder as claimed in claim 1 wherein the connecting means is articulated to enable the first circular member to be displaced selectively with respect to the second circular member to fittingly receive containers of different heights.

17. The holder as claimed in claim 12 wherein the connecting means is articulated to enable the first circular member to be displaced selectively with respect to the second circular member to fittingly receive containers of different heights.

18. The holder as claimed in claim 13 wherein the connecting means is articulated to enable the first circular member to be displaced selectively with respect to the second circular member to fittingly receive containers of different heights.

19. The holder as claimed in claim 15 wherein the connecting means is articulated to enable the first circular member to be displaced selectively with respect to the second circular member to fittingly receive containers of different heights.

20. A safety lid for use with a mug comprising: a circular member having a closed top portion, the top portion having an upper edge, a raised portion extending diametrically across the top portion level with the upper edge and having two recessed portions, each of the recessed portions having a rigid opening to permit the flow of beverage when being used by a consumer but operable to prevent beverage spill during ordinary handling, and a cylindrical skirt portion for encircling and attaching to the mug.

* * * * *